US009526388B2

(12) United States Patent
Riehl et al.

(10) Patent No.: US 9,526,388 B2
(45) Date of Patent: Dec. 27, 2016

(54) UPRIGHT VACUUM

(71) Applicant: WESSEL-WERK GmbH, Reichshof-Wilbergerhuette (DE)

(72) Inventors: Klaus-Dieter Riehl, Drolshagen (DE); Martin Zydke, Drolshagen (DE)

(73) Assignee: WESSEL-WERK GMBH, Reichshof-Wilbergerhuette (DE)

( * ) Notice: Subject to any disclaimer, the term of this patent is extended or adjusted under 35 U.S.C. 154(b) by 0 days.

(21) Appl. No.: 14/739,561

(22) Filed: Jun. 15, 2015

(65) Prior Publication Data

US 2015/0366423 A1 Dec. 24, 2015

Related U.S. Application Data

(60) Provisional application No. 62/013,780, filed on Jun. 18, 2014.

(51) Int. Cl.

| | |
|---|---|
| ***A47L 9/04*** | (2006.01) |
| ***A47L 9/00*** | (2006.01) |
| ***A47L 9/02*** | (2006.01) |

(52) U.S. Cl.

CPC ..... *A47L 9/0072* (2013.01); *A47L 9/02* (2013.01); *A47L 9/0494* (2013.01)

(58) Field of Classification Search

CPC ..... A47L 9/0072; A47L 9/0074; A47L 9/02; A47L 9/0477; A47L 9/0081; A47L 9/0494

See application file for complete search history.

(56) References Cited

U.S. PATENT DOCUMENTS

| | | | | |
|---|---|---|---|---|
| 8,214,967 | B2 * | 7/2012 | Knox | A47L 9/0477 15/363 |
| 8,555,462 | B2 * | 10/2013 | Maguire | A47L 9/0411 15/358 |
| 2007/0256273 | A1 * | 11/2007 | Coleman | A47L 9/0416 15/387 |
| 2014/0137366 | A1 * | 5/2014 | Elsdon | A47L 9/02 15/363 |
| 2015/0164294 | A1 * | 6/2015 | Staf | A47L 9/0072 15/347 |
| 2015/0374187 | A1 * | 12/2015 | Denhof | A47L 9/0477 15/353 |

* cited by examiner

*Primary Examiner* — Dung Van Nguyen
(74) *Attorney, Agent, or Firm* — Andrew Wilford

(57) ABSTRACT

A slide shoe is detachably mounted on the underside of a cleaning head and has a hole congruent with the suction hole of the cleaning head. The slide shoe can be retrofitted to the cleaning head of an already existing floor vacuum cleaner. On its underside, the slide shoe has a slide surface that can be moved easily over a soft carpet. At the same time, the slide shoe mounted on the underside of the cleaning head increases the distance between the bearing surface of the cleaning head and the brush roller compared to the bearing surface of the cleaning head without a slide shoe.

5 Claims, 3 Drawing Sheets

UPRIGHT VACUUM

CROSS REFERENCE TO RELATED APPLICATION

This application is the nonprovisional replacement of provisional application 62/013,780 filed 18 Jun. 2014.

FIELD OF THE INVENTION

The present invention relates to a floor vacuum cleaner. More particularly this invention concerns an upright vacuum cleaner with a cleaning head that has, on its underside, a suction hole and a rotatable roller brush in the suction hole.

BACKGROUND OF THE INVENTION

In an upright vacuum cleaner, all of the parts of the vacuum cleaner, particularly the blower, dirt collection chamber, handle and the cleaning head are combined in one device that is held in the hand and guided by the user. This type of vacuum cleaner has the advantage that no bothersome hose is present during use, and the entire vacuum cleaner can easily be guided using one hand. Such vacuum cleaners are very popular, especially in the USA. However, the invention can also be applied without restrictions in other types of vacuum cleaner (canister cleaners).

When handling a floor vacuum cleaner, a pressure load is applied to the floor surface to be cleaned via the cleaning head. Particularly in upright vacuum cleaners, the entire weight of the vacuum cleaner always rests with all accessories on the cleaning head. This is cumbersome, particularly when especially soft floor coverings are to be cleaned. The cleaning head then sinks deeply into them, thus impeding the flow of aspirated air. The cleaning performance drops rapidly.

This phenomenon occurs particularly with a new generation of carpets. The manufacturers have transitioned to the use of finer filaments with a diameter that is reduced by about 25% and, as a consequence, the filament count has increased from about 150 to 350 filaments per yarn. This results in especially soft carpets. Noteworthy here are the "Caress" products by the Shaw Company and the product "Smart Strand" of the Mohawk Company. These carpets have such a soft nap that upright vacuum cleaners sink deeply into it. In doing so, the edges of the suction mouth bury themselves forcefully into the nap, thus strongly and unpleasantly increasing the force that is required to push the vacuum cleaner. Moreover, the brush roller in the suction hole of the cleaning head is strongly braked by contact with the fiber nap. The drive can be overloaded as a result, which constitutes a safety risk and leads to the triggering of protective devices.

Previously, any height adjustment that might be available on the cleaning head was used as a stopgap. Alternatively or in addition, a secondary air hole can be provided to reduce the negative pressure in the suction conduit leading from the suction hole. This can also lead particularly to the roller space housing the brush rollers. However, these measures lead to an extreme worsening of the suction characteristics.

Against this backdrop, in order to achieve optimum suction characteristics, what would actually need to be developed are novel vacuum cleaner nozzles. Particularly in upright vacuum cleaners, however, cleaning heads can be changed only with great difficulty, so that the entire device would have to be changed. What is more, it is difficult to design such a new vacuum cleaner nozzle so that it is equally suited to conventional carpet floors as well.

OBJECT OF THE INVENTION

In this context, it is the object of the invention to improve the functional characteristics of the cleaning head of a floor vacuum cleaner on very soft fiber nap carpets.

SUMMARY OF THE INVENTION

According to the invention, a slide shoe is detachably mounted on the underside of the cleaning head. The slide shoe has a hole that is arranged congruently with the suction hole of the cleaning head. The slide shoe can be arranged subsequently as a purchased part on the cleaning head of an already existing floor vacuum cleaner. On its underside, the slide shoe has a sliding surface that can be moved easily over a soft carpet. At the same time, the slide shoe mounted on the underside of the cleaning head enlarges the distance between the bearing surface of the cleaning head and the brush roller compared to the bearing surface of the cleaning head without a slide shoe.

Running wheels on the cleaning head are recessed into the slide shoe or shielded by it such that they do not come into contact with a carpet floor. In that way, individual carpet fibers are prevented from snagging on or between the running wheels. Alternatively, recesses can also be provided in the slide shoe which enable use of the running wheels of the cleaning head.

Especially preferably, the slide shoe has a continuous, smooth and generally planar but slightly downwardly convex bottom surface as a sliding base. The sliding base is interrupted only by the sliding-shoe hole. As a result, nearly the entire bottom surface is available as a sliding base, which leads to advantageous sliding characteristics with low frictional resistance. In order to prevent excessively strong suction of the cleaning head on the floor surface, it can also be advantageous to provide air ventilation conduits on the sliding base. These are connected to the suction hole.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
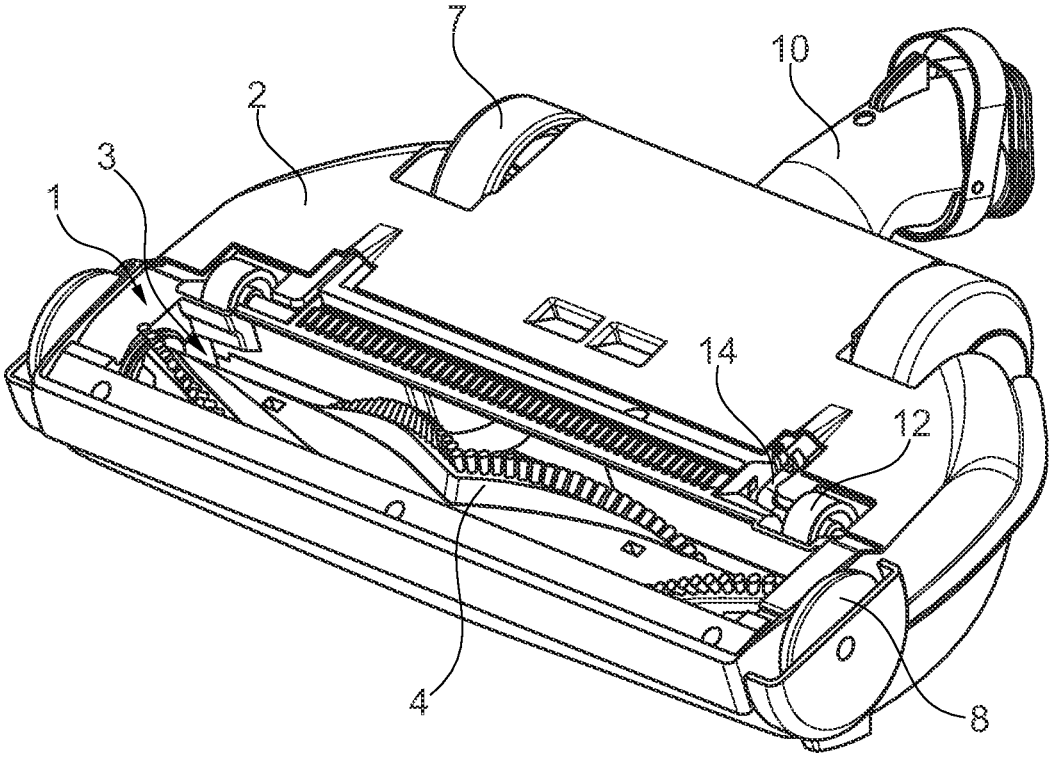
FIG. 1 is a perspective bottom view of a vacuum head according to the invention fitted with the accessory shoe of this invention.

FIG. 1 shows the underside of a cleaning head 1 for a floor vacuum cleaner, particularly an upright vacuum cleaner, with mounted sliding accessory shoe 2. The cleaning head 1 has a suction hole 3 and a rotatably driven brush roller 4 exposed in and projecting partly through this suction hole 3. The slide shoe 2 is connected detachably to the cleaning head 1 and is formed with a hole 5 (FIG. 3) of the same shape and size as the suction hole 3 of the cleaning head 1. The holes 3 and 5 are directly aligned when the accessory shoe 2 is mounted on the head 1. The slide shoe 2 has cutouts 6 for the running wheels 7 of the cleaning head 1. Two outer support wheels 8 are at the front on sides of the slide shoe 2 flanking the suction hole 3.

Figure 2:
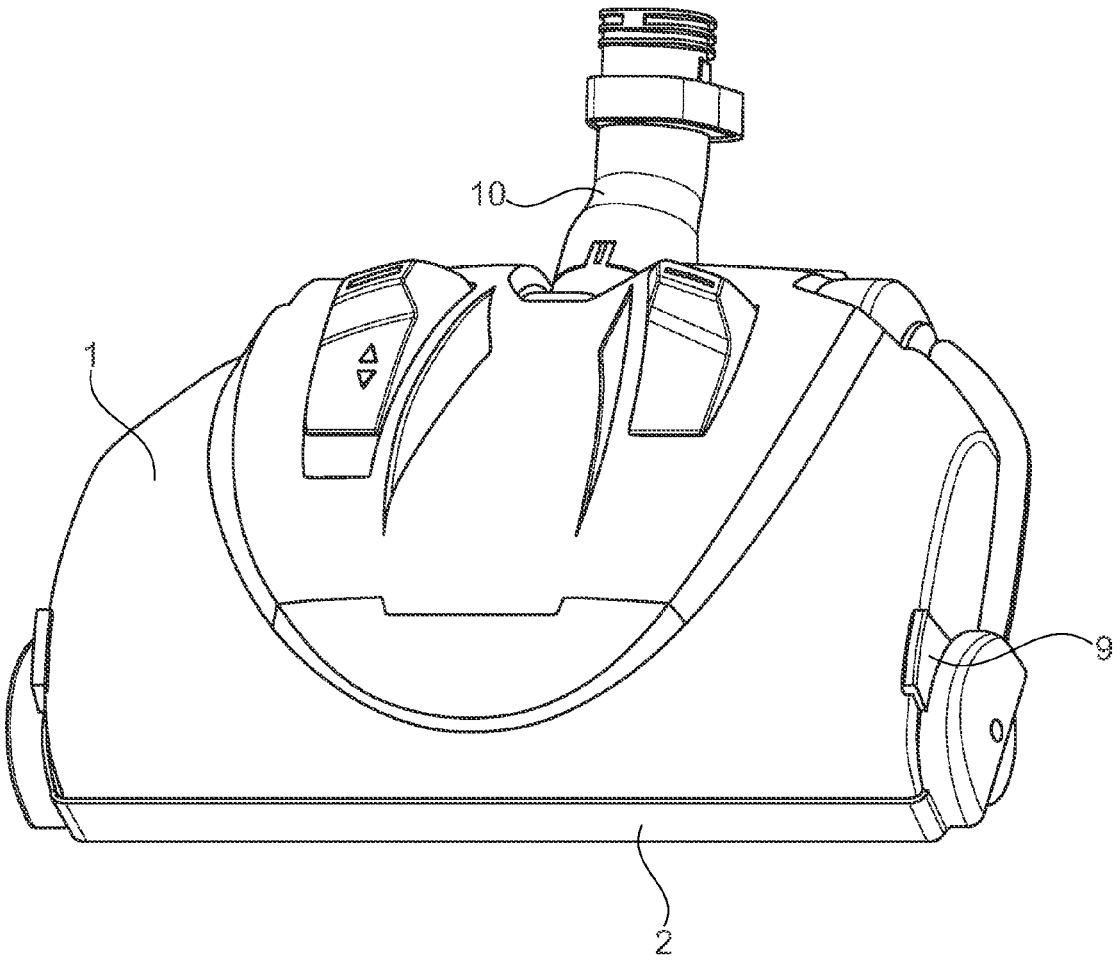
FIG. 2 is a top view of the vacuum head fitted with the accessory shoe of this invention.

FIG. 2 shows that the slide shoe is held by two locking retainer clips 9 that reach around to the upper side of the head 1. The slide shoe 2 encloses the cleaning head 1 circumferentially, thus further enlarging the sliding surface.

Figure 3:
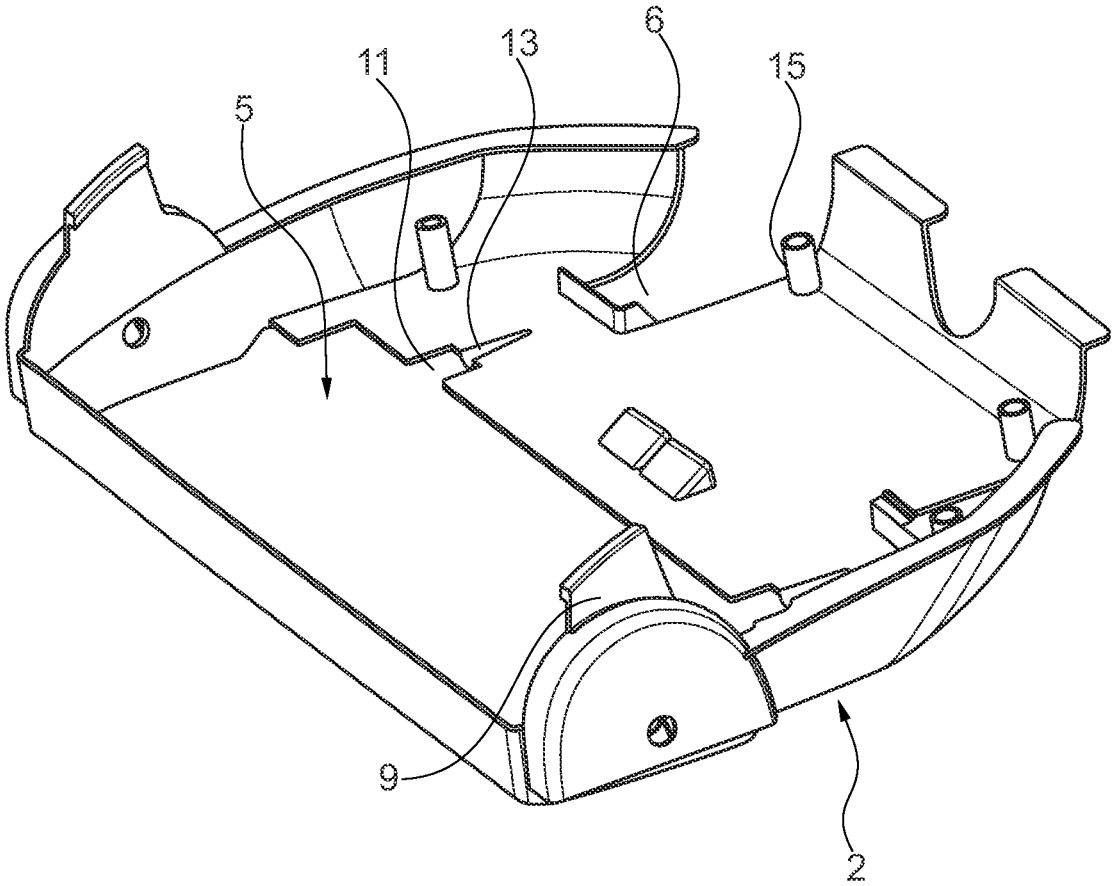
FIG. 3 is a perspective view of only the accessory shoe.

To facilitate understanding, FIG. 3 shows the slide shoe 2 before mounting on the cleaning head 1. The cutouts 6 for the running wheels 7 of the cleaning head 1 and for a suction hose connection 10 can be seen in the rear of the slide shoe 2. Further cutouts 11 opening forward into the hole 5 accommodate front adjustable rollers 12 of the cleaning head 1. There is also a depression 13 for receiving an adjustment-rod mechanism 14 connected to the rollers 12. To improve the fixation of the slide shoe 2 to the cleaning head 1, guide pins 15 are provided on the inner side of the slide shoe 2 that engage in respective holes on the underside of the cleaning head 1. The side parts of the slide shoe 2 are rounded off and fit completely around the underside of the cleaning head 1. Furthermore, the front support wheels 8 are mounted on the slide shoe 2 and enclosed by respective wheel wells. The slide shoe 2 can be manufactured as a plastic injection-molded part.

We claim:

1. A floor vacuum cleaner comprising:

a cleaning head having an underside formed with a suction hole and adapted to ride on a floor to support the head above the floor;

a rotatably driven brush roller in and projecting through the suction hole;

a slide shoe detachably mounted on the underside of the cleaning head and having a hole aligned with the suction hole of the cleaning head when mounted on the cleaning head; and means for releasably securing the slide shoe to the cleaning head over the suction hole thereof with the hole of the slide shoe aligned with the suction hole and the brush roller projecting through the slide shoe such that, with the slide shoe secured to the cleaning head, projection of the brush is reduced.

2. The floor vacuum cleaner defined in claim 1, wherein the underside of the slide shoe is smooth and continuous except at the suction hole.

3. The floor vacuum cleaner defined in claim 1, wherein the slide shoe is provided with floor-engaging wheels flanking the hole of the slide shoe.

4. A floor vacuum cleaner comprising:

a cleaning head having an underside formed with a suction hole;

a rotatably driven brush roller in the suction hole;

a slide shoe detachably mounted on the underside of the cleaning head and having a hole aligned with the suction hole of the cleaning head when mounted on the cleaning head; and unitary clips on the slide shoe that engage up and partially over the head to detachably retain the slide shoe on the head.

5. The floor vacuum cleaner defined in claim 1, wherein the slide shoe and clips are unitarily formed of plastic.

* * * * *